United States Patent [19]

DePooter

[11] 4,133,228

[45] Jan. 9, 1979

[54] PULL TAB OPENER

[76] Inventor: Clarence E. DePooter, 239 6th St. Ct., Andalusia, Ill. 61232

[21] Appl. No.: 812,236

[22] Filed: Jul. 1, 1977

[51] Int. Cl.[2] ..... B67B 7/44

[52] U.S. Cl. ..... 81/3.1 R; 81/3.46 A; 220/274

[58] Field of Search ..... 81/3.41, 3.46 R, 3.46 A, 81/3.47, 3.1 R; 145/46; 215/304; 220/270, 274; 294/26, 99 R, 103 R

[56] References Cited

U.S. PATENT DOCUMENTS

| | | | |
|---|---|---|---|
| 762,258 | 6/1904 | Starrett | 145/46 |
| 2,187,394 | 1/1940 | Glocker | 81/3.47 UX |
| 2,609,962 | 9/1952 | Schultz | 220/274 |
| 2,802,211 | 8/1957 | Friedman | 145/46 |
| 3,724,297 | 4/1973 | Bucko | 81/3.46 A |

*Primary Examiner*—Al Lawrence Smith
*Assistant Examiner*—James G. Smith
*Attorney, Agent, or Firm*—Daniel Jay Tick

[57] ABSTRACT

An elongated shaft-like member has spaced opposite first and second ends with a groove formed in the area of the first end thereof extending transversely to the member. The groove accommodates the ring-like part of the pull tab of a can. A resilient strip of material has spaced opposite first and second ends and is affixed at its first end to the shaft-like member at a point between the groove and the second end member. The strip extends parallel to the member, over the groove, and abuts at its second end the member at a point between the groove and the first end of the member for retaining the tab in the groove.

1 Claim, 5 Drawing Figures

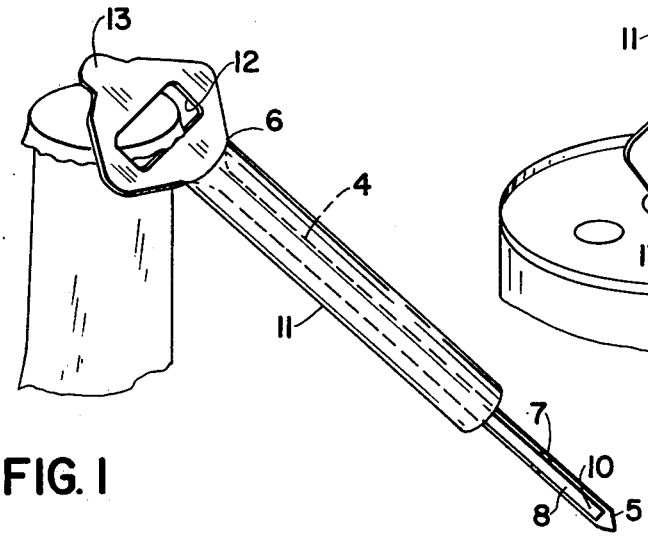
FIG. 1
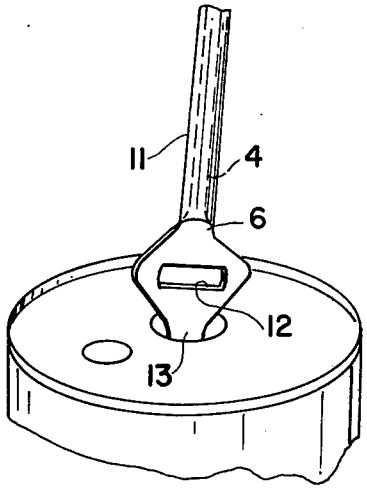
FIG. 5
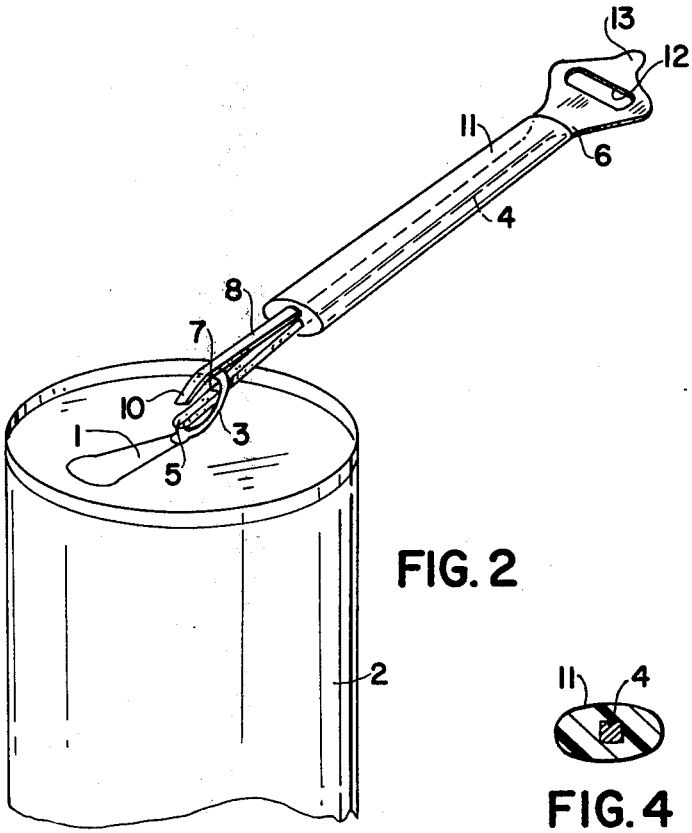
FIG. 2
FIG. 4
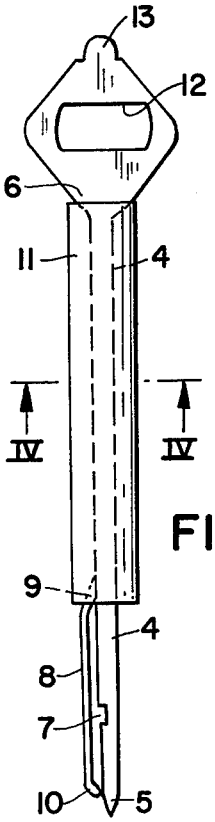
FIG. 3

PULL TAB OPENER

BACKGROUND OF THE INVENTION

The present invention relates to a pull tab opening tool. More particularly, the invention relates to a pull tab opening tool for removing a pull tab from a can. The pull tab has an enclosed ring-like part.

Objects of the invention are to provide a pull tab opening tool of simple structure, which is inexpensive in manufacture, used with facility, convenience and safety, and functions efficiently, effectively and reliably to remove a pull tab from a can without injuring or causing pain to a finger or fingernail of the person opening the can. The pull tab opening tool is especially adaptable for use by bartenders who open a plurality of cans in a relatively brief period and thereby injure their fingers.

BRIEF DESCRIPTION OF THE DRAWINGS

In order that the invention may be readily carried into effect, it will now be described with reference to the accompanying drawings, wherein:

FIG. 1 is a perspective view, of an embodiment of the pull tab opening tool of the invention in use removing the cap of a bottle;

FIG. 2 is a perspective view of the embodiment of FIG. 1 in use removing the pull tab of a can;

FIG. 3 is a side view, on an enlarged scale, of the embodiment of FIG. 1;

FIG. 4 is a cross-sectional view, taken along the lines IV—IV, of FIG. 3; and FIG. 5 is a view of the pull tab opening tool of the invention in use in depressing a prescored aperture in the top of a can.

DETAILED DESCRIPTION OF THE INVENTION

The pull tab opening tool of the invention removes a pull tab 1 (FIG. 2) from a can 2 (FIG. 2). The pull tab 1 has an enclosed ring-like part 3 (FIG. 2).

The pull tab opening tool of the invention comprises an elongated shaft-like member 4 having spaced opposite first and second ends 5 and 6 (FIGS. 1 to 4). A groove 7 is formed in the shaft-like member 4 in the area of the first end 5 thereof and extends transversely to said member, as shown in FIGS. 1 to 3. The groove 7 accommodates the ring-like part 3 of the pull tab 1, as shown in FIG. 2.

A substantially resilient strip of material 8 (FIGS. 1 to 3) has spaced opposite first and second ends 9 and 10 (FIG. 3). A strip of material 8 is affixed at its first end 9 to the shaft-like member 4 at a point between the groove 7 and the second end 6 of said member. The strip of material 8 extends substantially parallel to the member 4, over the groove 7, and abuts, at its second end 10, said member at a point between said groove and the first end 5 of said member for retaining the tab in the groove.

The first end 5 of the member 4 is preferably pointed, as shown in FIGS. 1 to 3.

The shaft-like member 4 is preferably covered with an elongated cylindrical plastic sheath 11 to provide comfort for a user grasping the tool.

A cap removing device 12 extends from the second end 6 of the member 4, as shown in FIGS. 1 to 3 and 5, and has a projection 13 extending coaxially therefrom for the purpose of depressing a previously scored area of a can, in the manner shown in FIG. 5. The projection 13 thus functions as a push or punch tool.

While the invention has been described by means of a specific example and in a specific embodiment, I do not wish to be limited thereto, for obvious modifications will occur to those skilled in the art without departing from the spirit and scope of the invention.

I claim:

1. A pull tab opening tool for removing a pull tab from a can, said pull tab having an enclosed ring-like part, said pull tab opening tool comprising an elongated shaft-like member having spaced opposite first and second ends, with a groove formed therein in the area of the first end thereof extending transversely to the member, said groove accommodating the ring-like part of a pull tab;

a substantially resilient strip of material having spaced opposite first and second ends, said strip of material being affixed at its first end to the shaft-like member at a point between the groove and the second end of said member, extending substantially parallel to said member and over said groove and abutting at its second end said member at a point between said groove and the first end of the said member for retaining the tab in the groove; and a cap removing device extending from the second end of the member.

* * * * *